US005824999A

United States Patent [19]

Kim et al.

[11] Patent Number: 5,824,999

[45] Date of Patent: Oct. 20, 1998

[54] MICROWAVE LEAKAGE-PREVENTING DEVICE FOR A MICROWAVE OVEN

[75] Inventors: Chul Kim; Yong-Woon Han; Han-Jun Sung; Seong-Deok Jang, all of Suwon, Rep. of Korea

[73] Assignee: Samsung Electronics Co., Ltd., Suwon, Rep. of Korea

[21] Appl. No.: 804,079

[22] Filed: Feb. 21, 1997

[30] Foreign Application Priority Data

| | | | |
|---|---|---|---|
| Feb. 23, 1996 | [KR] | Rep. of Korea | 1996-4368 |
| Feb. 23, 1996 | [KR] | Rep. of Korea | 1996-4369 |
| Feb. 23, 1996 | [KR] | Rep. of Korea | 1996-4370 |
| Oct. 5, 1996 | [KR] | Rep. of Korea | 1996-46080 |

[51] Int. Cl.[6] ..... H05B 6/76

[52] U.S. Cl. ..... 219/74.2; 219/744; 174/35 GC

[58] Field of Search ..... 219/742, 743, 219/741, 744, 739, 740, 738; 174/35 GC, 35 R

[56] References Cited

U.S. PATENT DOCUMENTS

| | | | |
|---|---|---|---|
| 2,500,676 | 3/1950 | Hall et al. . | |
| 3,182,164 | 5/1965 | Ironfield . | |
| 3,437,735 | 4/1969 | Schaller, Jr. | 219/741 |
| 3,448,232 | 6/1969 | Kluck | 219/741 |
| 3,651,300 | 3/1972 | Haagensen | 219/741 |
| 3,866,009 | 2/1975 | Ishino et al. | 219/744 |
| 4,313,044 | 1/1982 | Staats | 219/742 |
| 4,609,801 | 9/1986 | Spencer et al. | 219/756 |

FOREIGN PATENT DOCUMENTS

| | | | |
|---|---|---|---|
| 43-18839 | 8/1968 | Japan | 219/741 |
| 62/59437 | 12/1987 | Japan . | |
| 63/40036 | 8/1988 | Japan . | |
| 5/79641 | 3/1993 | Japan . | |
| 6/52986 | 2/1994 | Japan . | |

*Primary Examiner*—Philip H. Leung
*Attorney, Agent, or Firm*—Burns, Doane, Swecker & Mathis, L.L.P.

[57] ABSTRACT

A microwave oven door includes a shielding panel, which is made of a material through which microwaves cannot pass, having a contact section that opposes a front panel of the oven when the door is closed. A plurality of slits arranged in the contact section and/or the front panel, or both, prevent microwaves from leaking out through a gap formed between the front panel and the contact section. The slits are arranged in at least one row shaped as a closed loop and are evenly spaced from each other. The length of each slit corresponds to about ½ of a wavelength of a microwave, and the width of each slit corresponds to no more than 1/16 of the wavelength of the microwave. The interval between two adjacent slits corresponds to no more than 1/16 of the wavelength of the cooking microwave.

16 Claims, 14 Drawing Sheets

MICROWAVE LEAKAGE-PREVENTING DEVICE FOR A MICROWAVE OVEN

BACKGROUND OF THE INVENTION

The present invention relates to a microwave oven. More particularly, it relates to a device for preventing leakage of microwaves from a microwave oven, thereby enhancing its reliability.

A microwave oven cooks food by using approximately 2,450 MHz microwaves produced by a magnetron. The microwave oven includes a main body with a cooking chamber in which food is cooked, and a door that opens and closes the entrance to the cooking chamber. Leakage of microwaves furnished to the cooking chamber for cooking is deleterious to the human body, so the microwave oven's door and main body should be designed to prevent this from happening. Particularly, it is preferable that a microwave oven has a built-in microwave leakage-prevention mechanism. There are various techniques for preventing leakage of microwaves, the most common of which being a choke structure provided to a microwave oven's door.

In such a choke structure a recess of a given shape is formed in a predetermined spot on the microwave oven's main body or door. The depth of the recess corresponds to ¼ of the wavelength of a microwave used for cooking (hereinafter referred to as a "cooking microwave"). This makes impedance at the open end of the recess infinite in magnitude, thus restricting leakage of microwaves. There are several conventional techniques employing this choke structure as disclosed in U.S. Pat. Nos. 3,182,164 and 2,500,676, and Japanese Patent Laid-open Nos. Hei 5-79641 and Hei 6-52986.

FIG. 14 is a sectional view of a microwave oven disclosed in Japanese Patent Laid-open No. Hei 5-79641. The microwave oven 1 includes a main body 3 with a cooking chamber 2 and a door 4 for opening and closing the entrance to the cooking chamber 2. The door 4 contacts the main body 3's front panel 3*a* and includes a metallic shielding panel 5 and light-transmitting panels 6 and 7 respectively provided to the outside and inside of the shielding panel 5. On the center of the shielding panel 5 is a light-transmitting section 5*a* formed with a plurality of holes. A choke is provided at the edge of the shielding panel. The edge is designed to be bent for the formation of the choke, and an auxiliary panel 8 of a predetermined shape is joined thereto by welding. A predetermined sized recess 9, which is defined by the auxiliary panel 8 and the edge of the shielding panel, is formed to a depth of about 30.6 mm, which corresponds to ¼ of the wavelength of a cooking microwave.

This conventional choke structure makes the door's structure unnecessarily complex. Also, the steps wherein the shielding panel and auxiliary panel are bent and then welded together increase the total number of fabrication steps, raising the production costs. Additionally, since the depth of the recess corresponds to ¼ of the wavelength of a cooking microwave, the overall thickness of the door and the contact area between the door and the front panel of the main body 3 are increased. Accordingly, the effective capacity of the cooking chamber decreases, and the size of the light-transmitting section is small, preventing ambient light from illuminating the contents of the cooking chamber.

Recently, as disclosed in Japanese Patent Publication Nos. Sho 62-59437 and Sho 63-40036, research and development has been devoted to the reduction of the recess's depth in order to decrease the thickness of the door and increase the effective cooking space. However, these techniques still employ the conventional choke structure so the reduction of the door's thickness is limited. Moreover, the bending and welding processes for the formation of the recess are carried out, thus increasing the number of fabrication steps and raising the overall production costs.

SUMMARY OF THE INVENTION

The present invention is a device for preventing leakage of microwaves from a microwave oven that can obviate the above problems and disadvantages of the conventional technique.

It is an object of the present invention to provide a device for preventing leakage of microwaves from a microwave oven which is of an improved structure that simplifies the door construction of the microwave oven and the steps in the manufacture of the microwave oven.

It is another object of the present invention to provide a device for preventing leakage of microwaves from a microwave oven which reduces the thickness of the microwave oven's door and the contact surface of the door and microwave oven's front panel, and increases the effective cooking space of the cooking chamber and the size of the door's light-transmitting section so as to increase the illumination of the cooking chamber.

According to an aspect of the present invention, a microwave oven including a cooking chamber which has opening and to which cooking microwaves are emitted, a front panel defining the contour of the opening, and a door for opening or closing the opening of the cooking chamber, is characterized in that the door includes a shielding panel made of a material through which microwaves cannot pass that has a contact section contacting the front panel when the door is closed and a plurality of slits are arranged on the contact section so as to prevent the microwaves from leaking out through the gap between the front panel and the contact section. The slits are formed along the contour of the overall contact section, evenly spaced from each other.

The length of each of the slits corresponds to about ½ of a wavelength of microwaves emitted to the cooking chamber for cooking. The width of each of the slits corresponds to 1/32 of the wavelength of the microwaves or less, and the interval between two adjacent slits corresponds to 1/32 of the wavelength of the used microwaves or less.

According to another aspect of the present invention, a microwave oven including a cooking chamber which has one opening and to which cooking microwaves are emitted, a grounded front panel defining the contour of the opening, and a door for opening or closing the opening of the cooking chamber, is characterized in that the door includes a shielding panel made of a material through which microwaves can not pass, and a plurality of slits are arranged on the front panel so as to prevent the microwaves from leaking out through the gap between the front panel and the shielding panel.

According to still another aspect of the present invention, a microwave oven including a cooking chamber which has one opening and to which cooking microwaves are emitted, a grounded front panel defining the contour of the opening, and a door for opening or closing the opening of the cooking chamber, is characterized in that the door includes a grounded shielding panel made of a material through which microwaves can not pass that has a contact section contacting the front panel when the door is closed and a plurality of slits are arranged on both the contact section and the front panel so as to prevent the microwaves from leaking out through the gap between the front panel and the contact section.

BRIEF DESCRIPTION OF THE ATTACHED DRAWINGS

Figure 13A:
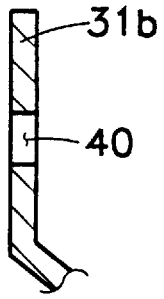
Figure 14:
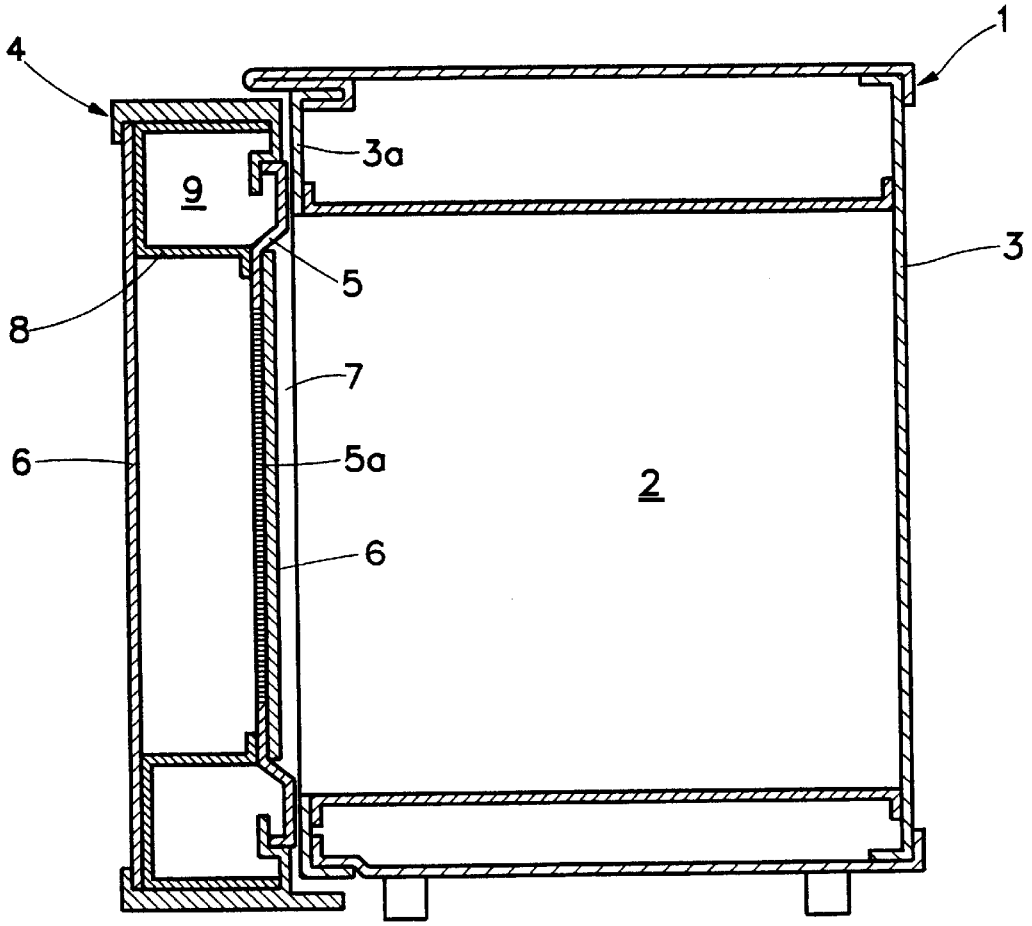
Fig.14 (Prior Art)

FIGS. 13*a,* 13*b* and 13*c* respectively depict absorbing pieces that are formed around a blocking slit in accordance with the preferred embodiments; and FIG. 14 is a sectional view of a conventional microwave oven.

DETAILED DESCRIPTION OF THE PREFERRED EMBODIMENTS

Preferred embodiments of the present invention will be fully described referring to the accompanying drawings.

Figure 1:
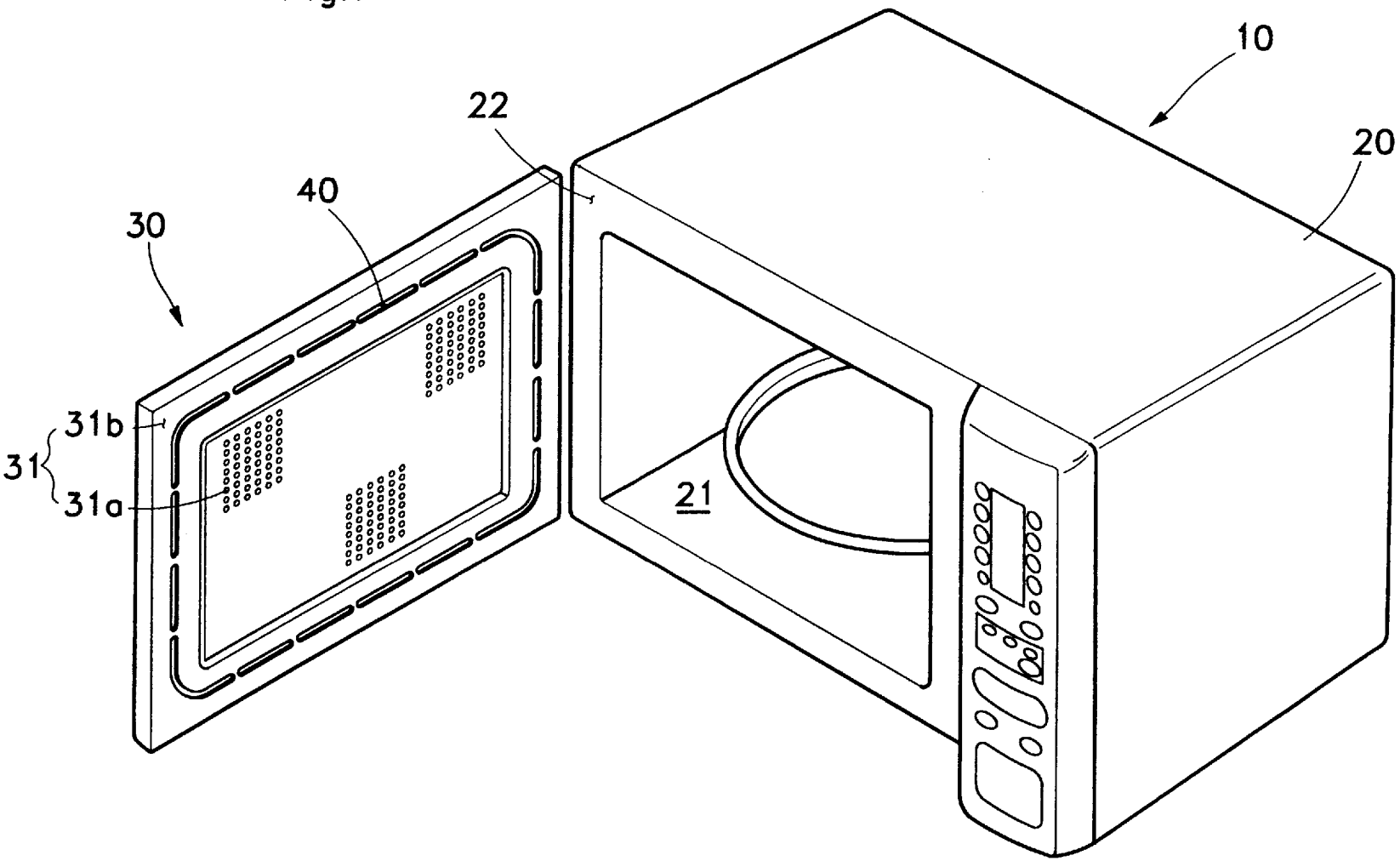
FIG. 1 is a perspective view of a microwave oven, the door of which is open, in accordance with the first preferred embodiment.
Figure 2:
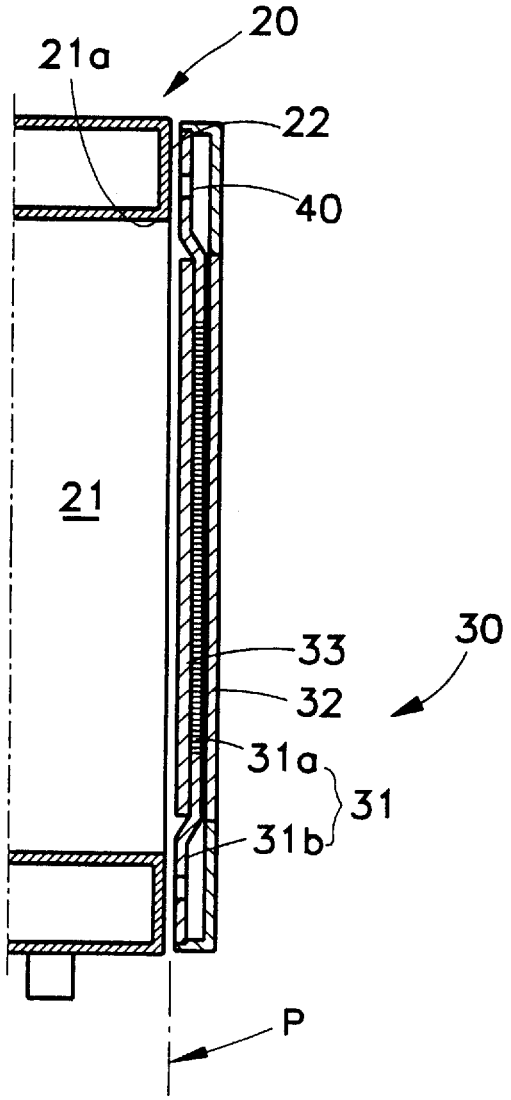
FIG. 2 is a sectional view of the front of a microwave oven, the door of which is closed, in accordance with the first preferred embodiment.
Figure 3:
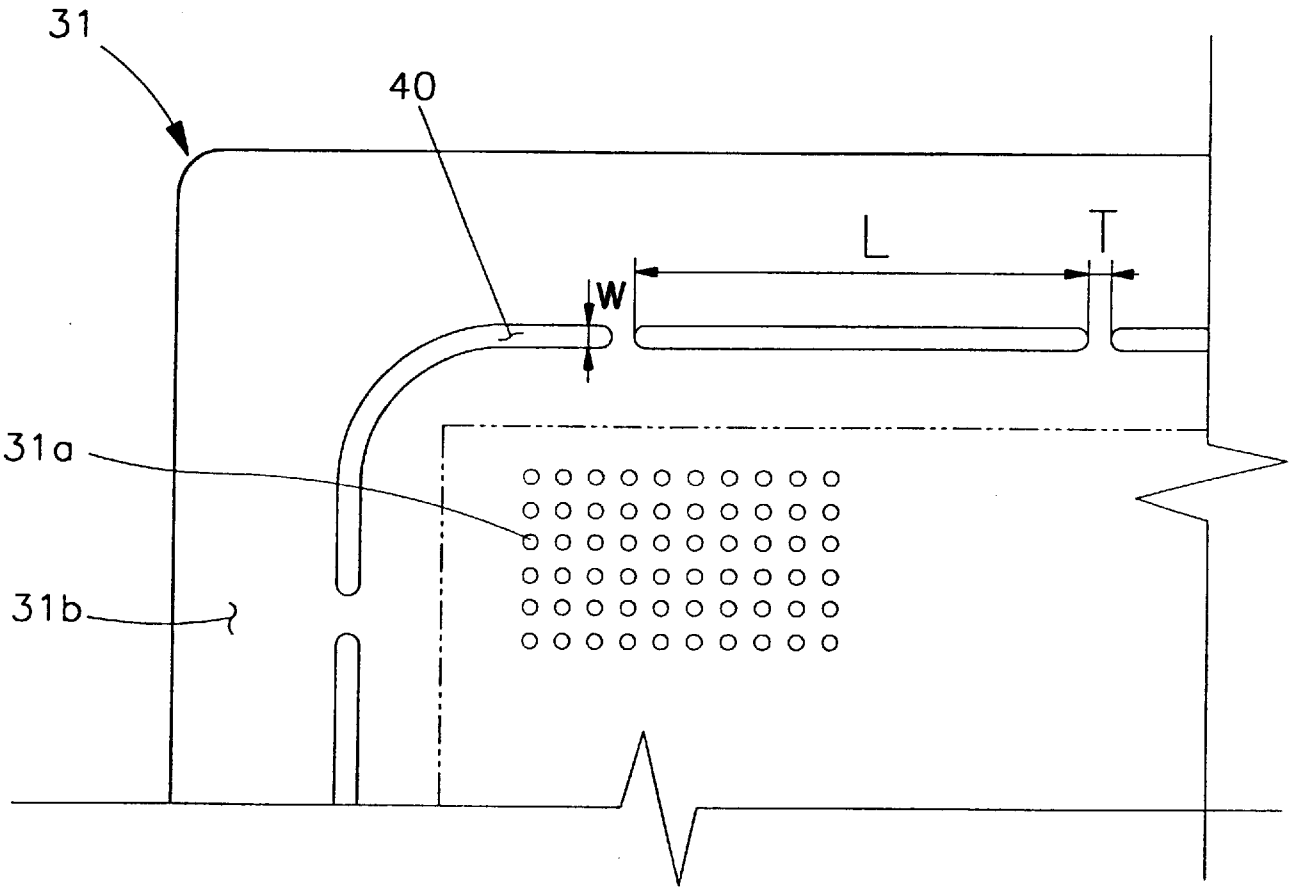
FIG. 3 is a front view of a portion of the shielding panel of FIG. 2.

FIGS. 1 to 3 show the first preferred embodiment of the present invention. Referring to FIG. 1, a microwave oven of the present invention includes a main body 20 having a front panel 22 defining an opening 21*a,* a cooking chamber 21, and a door 30 provided to the main body 20 to open and close the opening 21*a* of the cooking chamber 21. The door 30 is large enough to come in contact with the front panel 22 of the main body 20 when closed. A device for preventing leakage of microwaves produced by a magnetron (not illustrated) is provided around the contact area of the door 30 and the front panel 22.

Referring to FIG. 2, the construction of the door 30 will be described in detail.

The door 30 includes an electrically grounded shielding panel 31 made of a material through which microwaves cannot pass, such as metal, and light-transmitting panels 32 and 33 respectively provided to the front and back of the shielding panel 31 so as to prevent the microwaves from leaking out. The light-transmitting panels 32 and 33 are made of transparent glass so as to allow the user to view the contents of the cooking chamber 21. The panel 33 is not necessarily needed.

The shielding panel 31 includes a light-transmitting section 31*a* with a plurality of holes for preventing the passage of microwaves but still allowing the passage of light, and a contact section 31*b* which contacts the front panel 22 of the main body 20 when the door 30 is closed. The shielding panel 31 is planar in shape, however it is preferable that the light-transmitting section 31*a* be slightly recessed away from the cooking chamber 21 with respect to the contact section 31*b* in order that the light-transmitting panels 32 and 33 can be attached to the front and back surfaces of the shielding panel 31, respectively.

On the contact section 31*b* a plurality of blocking slits 40 are formed to extend around all of the sides of the multi-sided opening of the cooking chamber. The blocking slits 40 are formed to prevent microwaves from leaking out through the gap between the shielding panel 31 of the door 30 and the front panel 22. That gap defines a plane P (FIG. 2). As shown in FIGS. 1 and 3, the blocking slits 40 are designed to be long and thin and arranged evenly spaced from each other so that they form a row of closed-loop shape on the contact section 31*b* along the perimeter of the light-transmitting section 31*a.* The overall closed loop shape of the row of blocking slits 40 corresponds to the contour of the front panel, so a given blocking slit 40 may be rectangular, elliptic or quadrilateral. Since the blocking slits 40 are formed on the grounded shielding panel 31, they serve to absorb microwaves passing between the shielding panel 31 and the front panel 22. They also serve as a slot antenna like a dipole antenna. The shielding panel 31 is grounded so each blocking slit 40 functions as a resonator and acts as a bandstop filter that absorbs radio waves of a predetermined band. Therefore, forming the blocking slits 40 along the contour of the contact section 31*b* prevents microwaves of a predetermined frequency band from leaking out.

The following description relates to the length L and width W of each of the blocking slits 40 and the interval T between two adjacent blocking slits 40, with reference to FIG. 3.

As described above, each of the blocking slits 40 serves as a bandstop filter, and they may absorb the microwaves more effectively by making the length L of each slit correspond to ½ of the wavelength of a microwave used by the microwave oven. This is similar to a dipole antenna's electric wave emission and absorption principles.

Since the microwave oven uses microwaves of 2,450 MHz to 2,500 MHz, the length L of the blocking slit 40 is approximately 60 to 62 mm so as to maximally absorb the microwave frequencies. In this preferred embodiment, its length L is 61 mm. The width W of the blocking slit 40 is related to the frequency band of the cooking microwaves and the blocking slit's absorption factor. When increasing the width W of the blocking slit 40, the range of frequency waves that the blocking slit 40 can absorb becomes larger, and the electric wave absorption factor (attenuation factor) decreases.

On the contrary, when decreasing the width W of the blocking slit 40, the electric wave absorption factor increases, and the range of frequency waves that the blocking slit 40 can absorb becomes smaller. In consideration of these two factors, the width W of the blocking slit 40 is set to, or less of the wavelength of the cooking microwaves. The most preferable width W of the blocking slit 40 corresponds to 1/32 of the wavelength of the cooking microwaves. Its optimum width W has been obtained from a series of experiments. When the cooking microwaves are in the range of 2,450 MHz to 2,500 MHz, the width W of the blocking slit 40 may be selected in the range of 0.5 to 8 mm. In this preferred embodiment, the width W is 3 mm. The interval T between two adjacent blocking slits 40 should be set properly. The smaller the interval T becomes, the more the blocking slits 40 will absorb microwaves effectively. It is difficult to form the blocking slits 40 extremely close to each other. However, setting the interval T to 1/32 or less of the wavelength of the cooking microwaves, corresponding to the range of 2 to 5 mm, microwave leakage is satisfactorily booked. The blocking slits 40 are formed a press work. In the first preferred embodiment, the interval T between two adjacent blocking slits on the horizontal region of the contact section 31*b* is 3 mm, and the interval T between adjacent slits on the vertical region is 5 mm.

Figure 4:
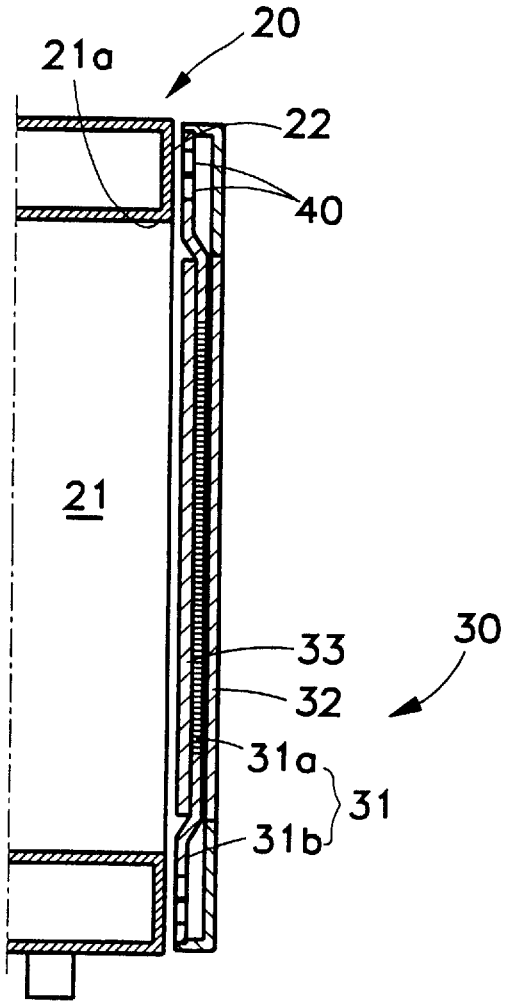
FIG. 4 is a sectional view of the front of a microwave oven, the door which is closed, in accordance with the second preferred embodiment.
Figure 5:
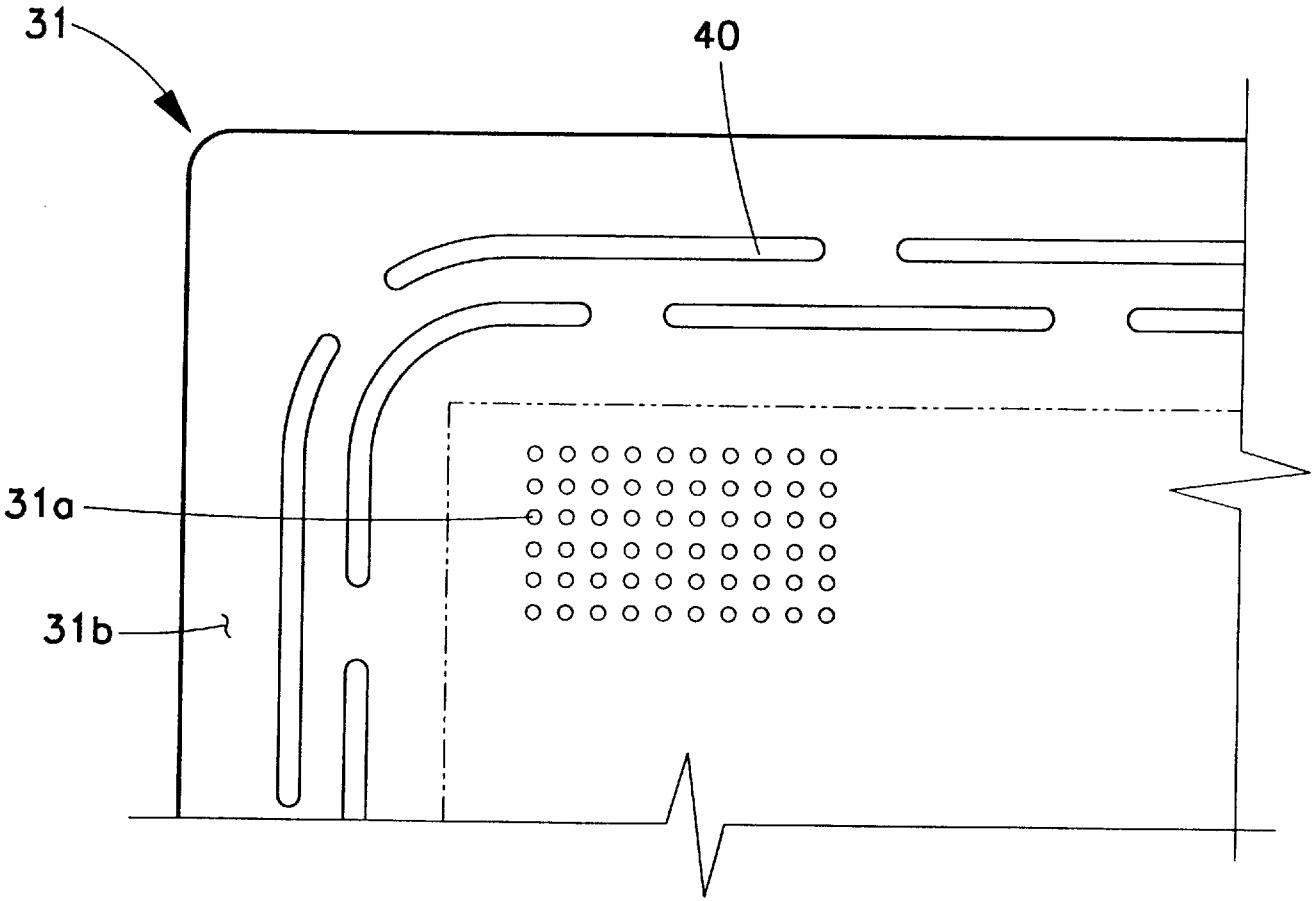
FIG. 5 is a front view of a portion of the shielding panel of FIG. 2.

Referring to FIGS. 4 and 5, the second preferred embodiment of the present invention will now be described in detail.

The second preferred embodiment differs from the first one on the point that blocking slits 40 are arranged in two rows. The length L and width W of each of the blocking slits 40 are set according to the first preferred embodiment. The interval T between two adjacent blocking slits 40 is a little larger than that of the first preferred embodiment. Additionally, the blocking slits 40 of the two rows are alternately (i.e., staggered) on the shielding panel 31 so that the microwaves are first absorbed by the blocking slits 40 of the first row and then absorbed by the slits 40 of the second row. This arrangement completely blocks microwave leakage from the cooking chamber 21. There is no limit to the number of the blocking slits' rows, so they may form several rows.

Figure 6:
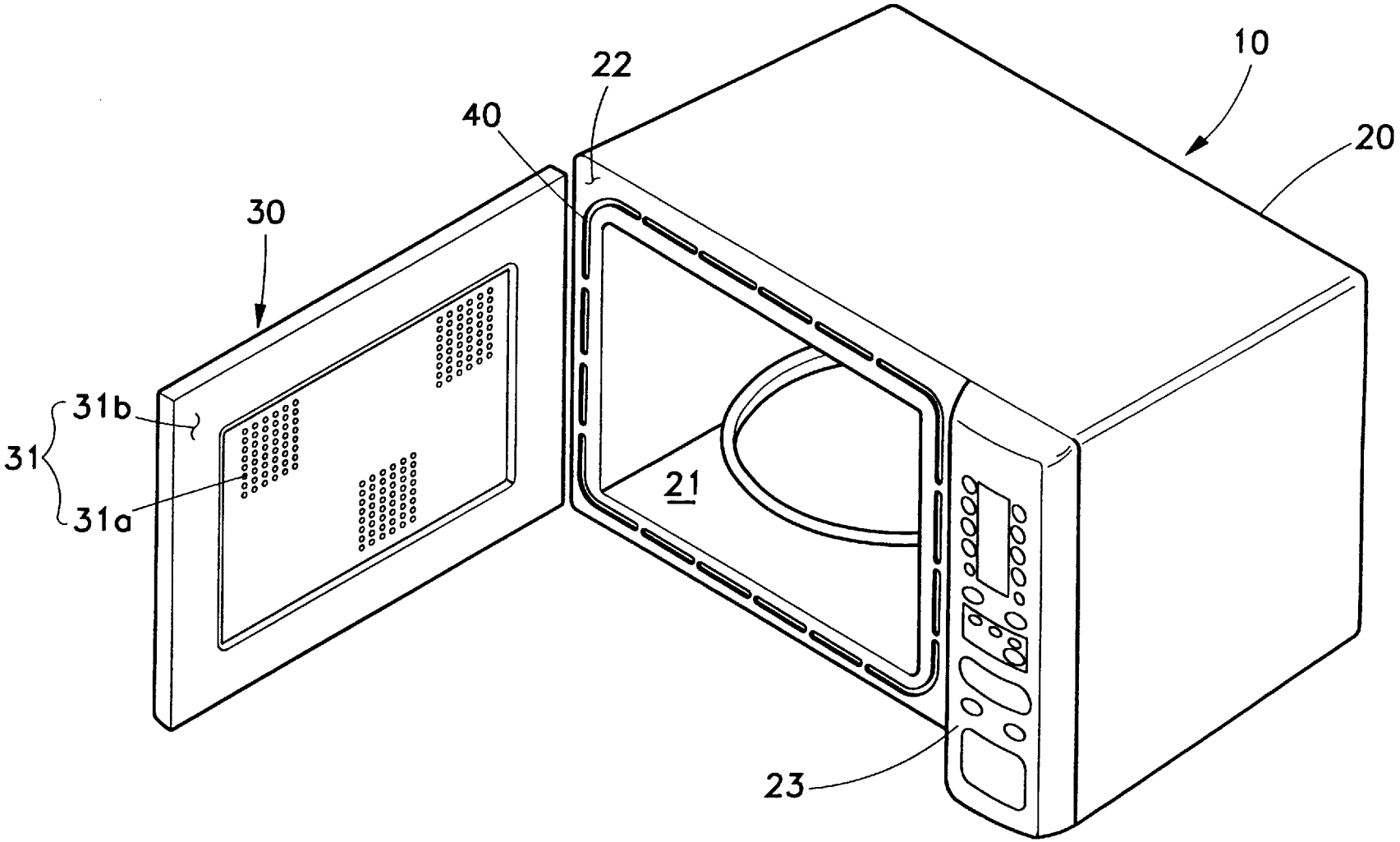
FIG. 6 is a perspective view of a microwave oven, the door of which is open, in accordance with the third preferred embodiment.
Figure 7:
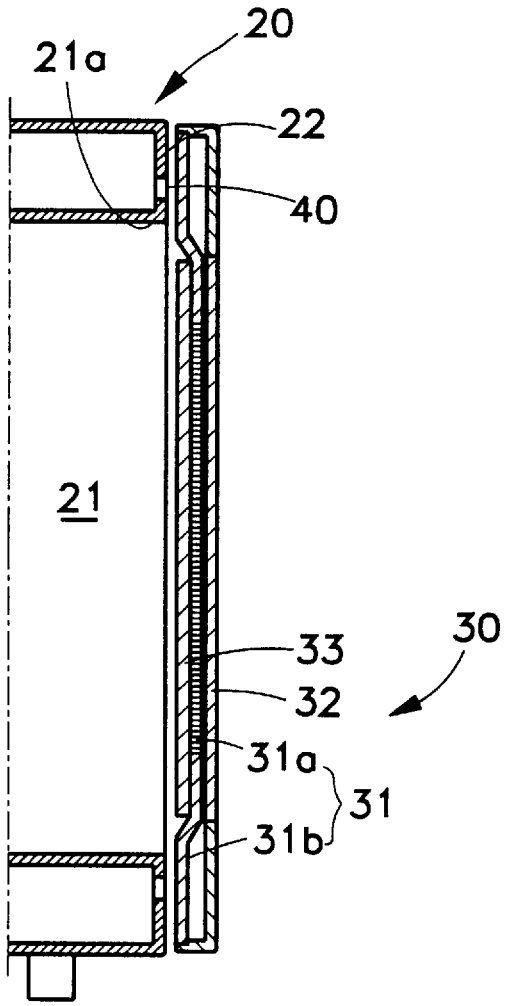
FIG. 7 is a sectional view of the front of a microwave oven, the door of which is closed, in accordance with the third preferred embodiment.
Figure 8:
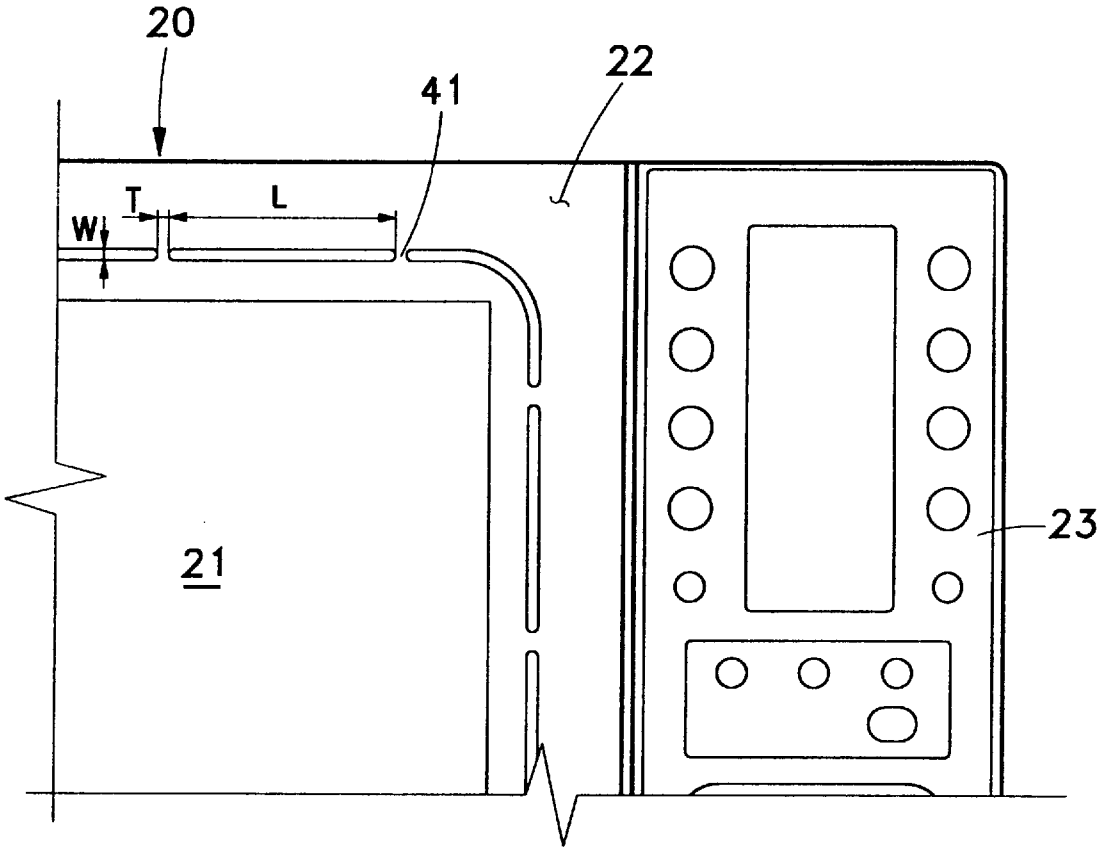
FIG. 8 is a front view of a portion of the shielding panel of FIG. 7.

FIGS. 6, 7 and 8 relate to the third preferred embodiment of the present invention, wherein the slits 40 are formed in the front panel 22 of the main body 20, i.e., in a single row. As shown in the drawings, the length L and the width W of each of the blocking slits 40 and an interval T between two adjacent blocking slits 40 are set according to the first preferred embodiment. Therefore, the description about them will be omitted in the third preferred embodiment.

Figure 9:
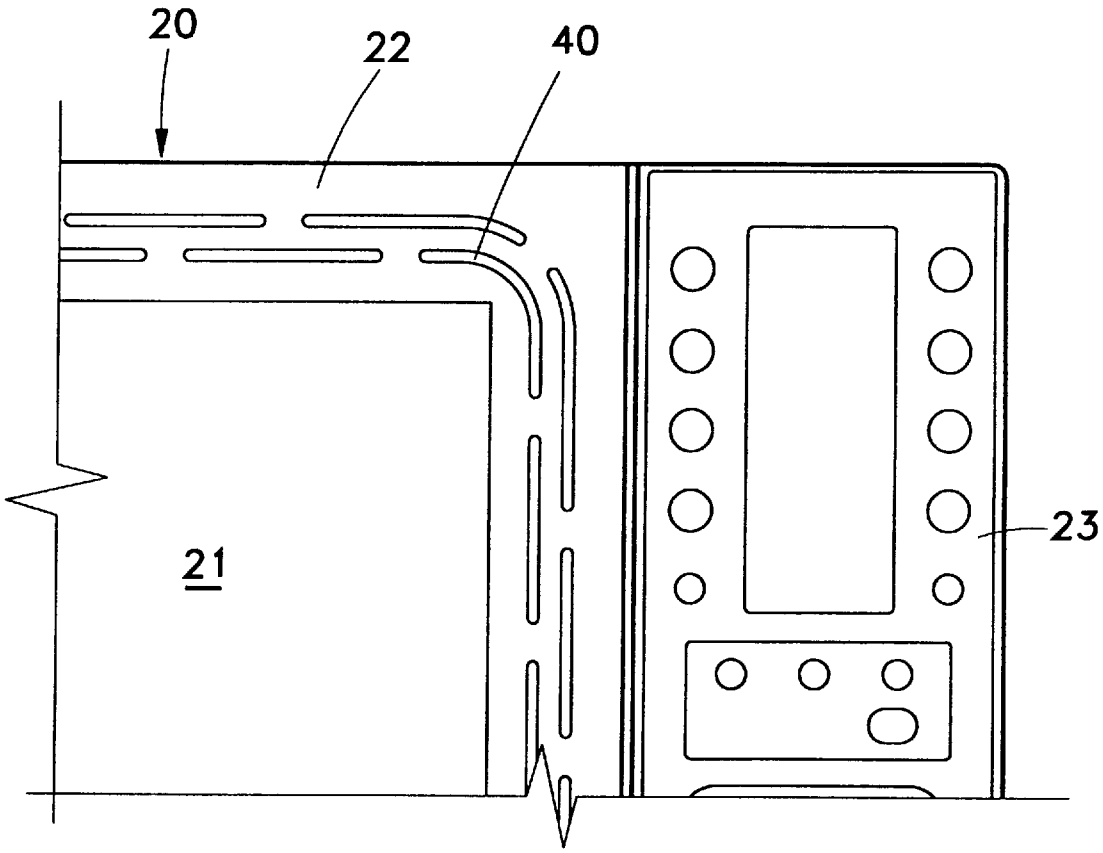
FIG. 9 is a front view of a portion of the shielding panel in accordance with the fourth preferred embodiment.

FIG. 9 shows the fourth embodiment of the present invention. Blocking slits 40 are again formed on the front panel 22 of the main body 20, and they are arranged in two rows. The reference numeral "23" denotes a control panel.

Figure 10:
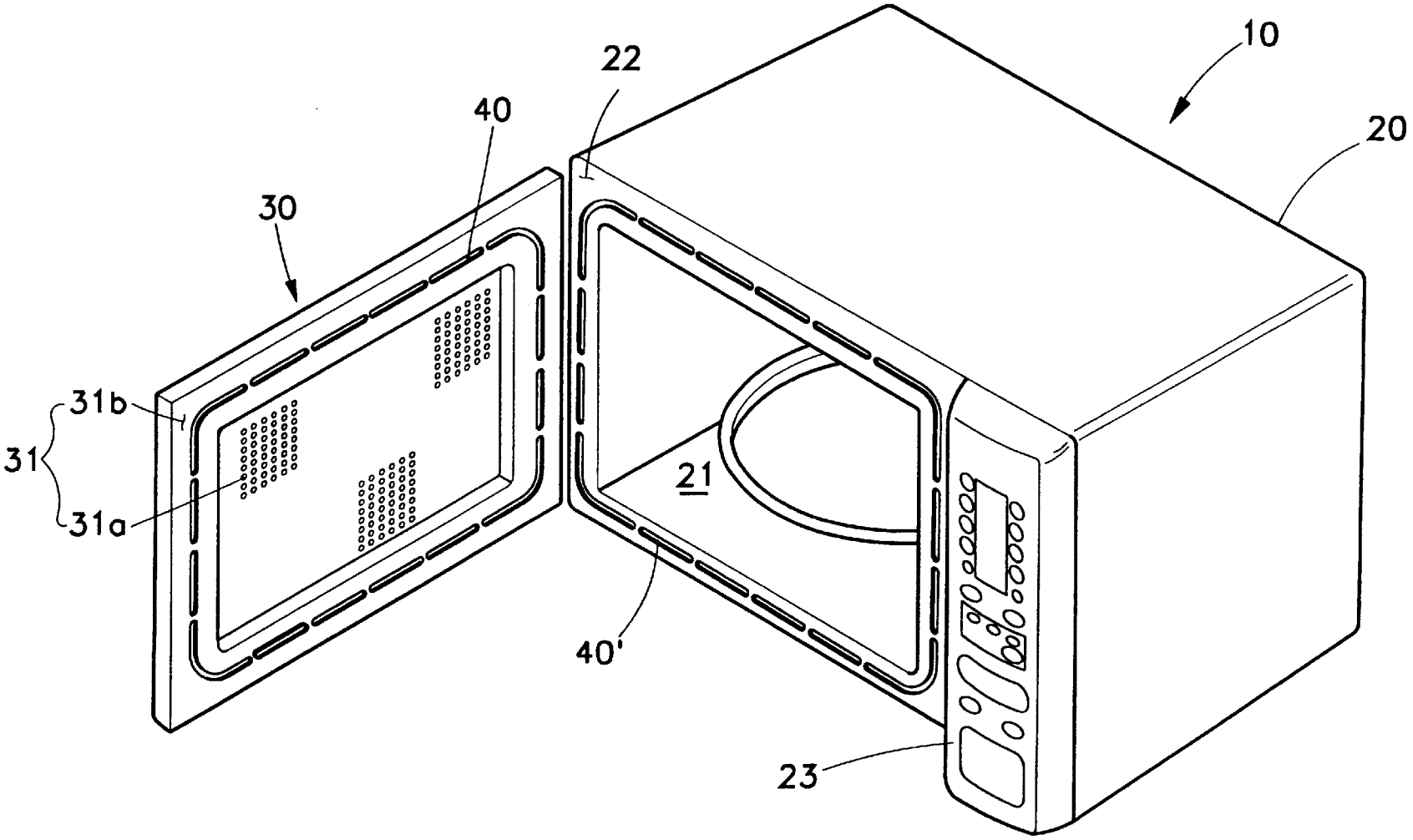
FIG. 10 is a perspective view of a microwave oven, the door of which is open, in accordance with the fifth preferred embodiment.
Figure 11:
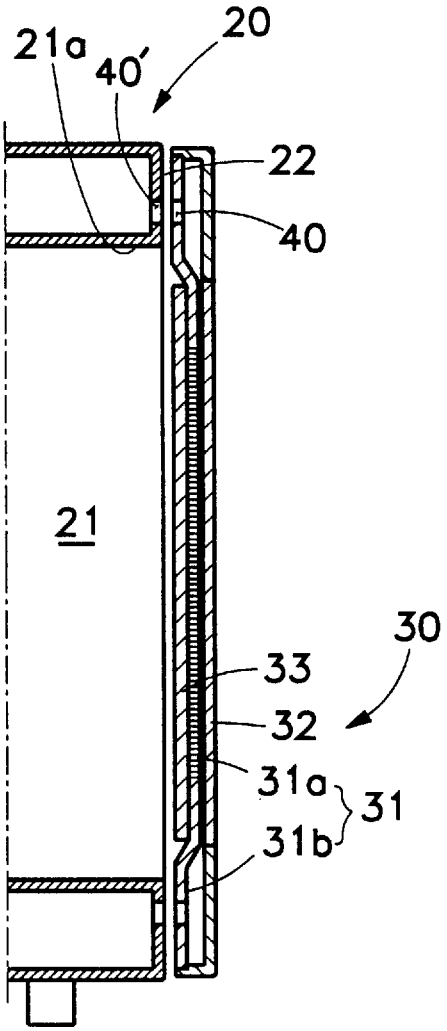
FIG. 11 is a sectional view of the front of a microwave oven, the door of which is closed, in accordance with the fifth preferred embodiment.

FIGS. 10 and 11 each illustrate the fifth preferred embodiment. Blocking slits are formed on both the front panel 22 of the main body 20 and the contact section 31*b* of the door 30. Reference numeral 40 denotes blocking slits formed on the door 30, and 41' denotes blocking slits formed on the front panel 22 of the main body 20. In this preferred embodiment, the length L and width W of each of the blocking slits 40 and 40' and the interval T between two adjacent blocking slits 40 are set according to the first preferred embodiment, therefore the description about them will be omitted in this preferred embodiment.

Figure 12:
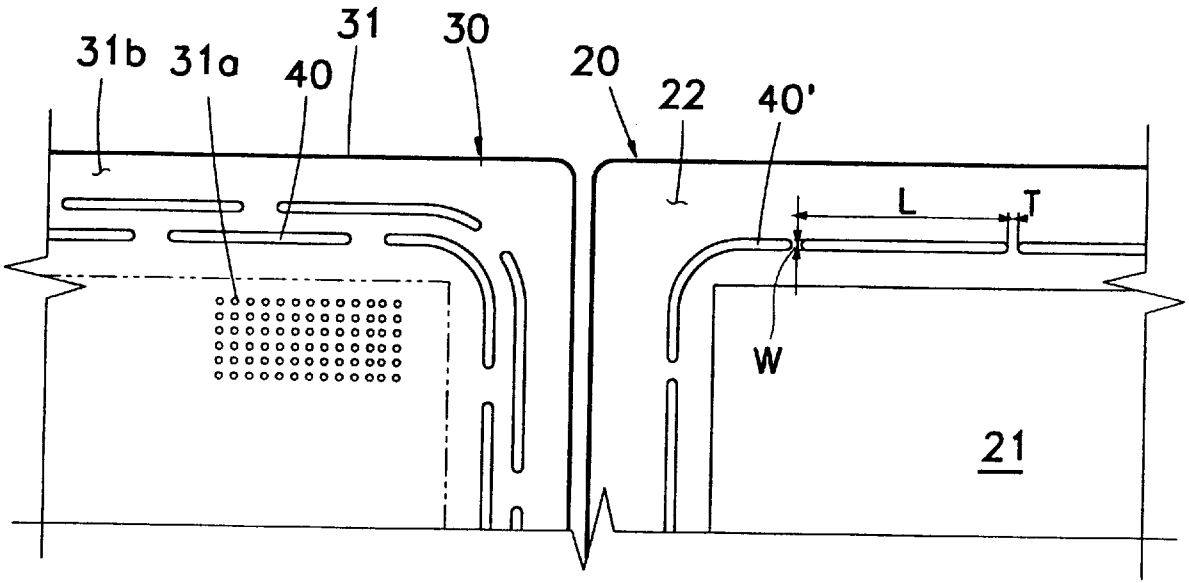
FIG. 12 is a front view of a portion of the shielding panel in accordance with the sixth preferred embodiment.

FIG. 12 illustrates the sixth preferred embodiment of the present invention. Blocking slits 40 are formed in two rows on the contact section 31*b* of the door 30, and blocking slits 40' in a single row are arranged on the front panel 22 of the main body 20 in such a way that a given slit 40' on the front panel 22 lies between the two rows of the slits 40 on the contact section 31*b*.

Referring to 13*a*, 13*b* and 13*c*, an absorbing piece formed around each blocking slit 40 will now be described.

Figure 13B:
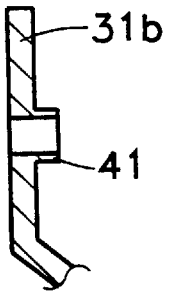
Figure 13C:
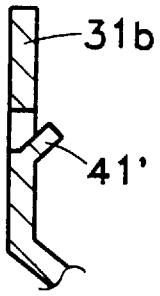

FIG. 13*a* depicts a blocking slit 40 without an absorbing piece or projection. FIG. 13*b* shows an absorbing piece 41 of a cylindrical shape, and FIG. 13*c* depicts an inclined absorbing piece 41'. These protruding absorbing pieces 41 and 41' help to block microwaves more effectively.

The following description relates to the effects and advantages of the present invention.

According to the present invention, the shielding panel formed as a simple plane, and the microwave leakage-prevention mechanism is realized through simple slits so that a process of manufacturing a shielding panel is simplified and the production costs are lowered. In other words, according to the conventional choke structure, the shielding panel and the auxiliary panel must be bent and welded together for the formation of a recess corresponding to 1/4 of the wavelength of cooking microwaves. Compared to this, the present invention provides blocking slits formed by simple pressing, thus lowering the production costs and reducing the number of fabrication steps.

Since the shielding panel is formed as a simple plane, the thickness of the door and the width of the contact section are reduced, and thus, the thickness of the main body is reduced, thereby increasing the effective cooking space of the oven's cooking chamber. In addition, the width of each of the blocking slits is significantly reduced, thus increasing the size of the light-transmitting section, thereby enhancing the illumination of the cooking chamber compared to the conventional choke structure.

What is claimed is:

1. A microwave oven including a cooking chamber to which cooking microwaves are emitted, the cooking chamber having a front panel defining a multi-sided opening, and a door for opening or closing said opening, said door including a shielding panel made of a material through which microwaves cannot pass, said shielding panel having a contact section disposed opposite an opposing portion of said front panel when said door is closed and forming a gap therewith, said gap defining a plane, and a microwave shield extending around all sides of said opening to prevent microwaves from leaking through said gap, said shield comprising a row of spaced-apart slits formed in at least one of said contact section and said opposing portion of said front panel, said slits lying in a closed loop surrounding said opening, each slit being elongated in a direction of said closed loop.

2. A microwave oven as set forth in claim 1, wherein a length of each of said slits corresponds to about 1/2 of a wavelength of a cooking microwave.

3. A microwave oven as set forth in claim 1, wherein a width of each of said slits corresponds to no more than 1/16 of a wavelength of a cooking microwave.

4. A microwave oven as set forth in claim 1, wherein an interval between two adjacent slits corresponds to no more than 1/16 of a wavelength of a cooking microwave.

5. A microwave oven as set forth in claim 1, wherein a length of each of said slits corresponds to no more than 1/2 of a wavelength of a cooking microwave, a width of each of said slits corresponding to no more than 1/32 of the wavelength of the cooking microwave, and an interval between two adjacent slits corresponding to no more than 1/32 of the wavelength of the cooking microwave.

6. A microwave oven as set forth in claim 1, wherein a length and width of each slit are in respective ranges of about 60 mm to 62 mm, and 0.5 mm to 8 mm and an interval between two adjacent slits is in a range of about 2 mm to 5 mm.

7. A microwave oven as set forth in claim 1, wherein each of said slits has an absorbing piece in the form of a projection extending from an edge of said slit.

8. A microwave oven as set forth in claim 1, wherein said shielding panel is electrically grounded.

9. A microwave oven as set forth in claim 1 wherein said slits are formed only in said contact section.

10. A microwave oven as set forth in claim 1 wherein said slits are formed only in said front panel.

11. A microwave oven as set forth in claim 1 wherein a row of said slits is formed in both said contact section and said opposing portion of said front panel.

12. A microwave oven as set forth in claim 11 wherein said rows of slits in said contact section and said front panel face one another when said door is closed.

13. A microwave oven as set forth in claim 1 wherein said row of slits constitutes a first row, and said path constitutes a first path, said shield further comprising a second row of slits formed in at least one of said contact section and said opposing portion of said front panel, said second row of slits lying in a second path surrounding said first path, each slit of said second row being elongated in a direction of said second path, each slit of said second row including opposite ends aligned with respective ends of two adjacent slits in said second row.

14. A microwave oven according to claim 13 wherein said slits of said first row are staggered with respect to said slits of said second row.

15. A microwave oven as set forth in claim 13 wherein both of said first and second rows are formed in the same one of said contact section and said opposing portion.

16. A microwave oven as set forth in claim 15, wherein said shield further comprises a third row of slits formed in the other of said contact section and said opposing portion which does not contain said first and second rows, said third row situated intermediate said first and second rows, said third row lying in a third path surrounding said opening, each slit of said third row being elongated in a direction of said third path, each slit of said third row including opposite ends aligned with respective ends of two adjacent slits in said third row.

* * * * *